US006572444B1

(12) United States Patent
Ball et al.

(10) Patent No.: US 6,572,444 B1
(45) Date of Patent: Jun. 3, 2003

(54) APPARATUS AND METHODS OF AUTOMATED WAFER-GRINDING USING GRINDING SURFACE POSITION MONITORING

(75) Inventors: Michael B. Ball, Boise, ID (US); Chad A. Cobbley, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 106 days.

(21) Appl. No.: 09/655,002

(22) Filed: Aug. 31, 2000

(51) Int. Cl.[7] ..... B24B 49/00

(52) U.S. Cl. ..... 451/10; 451/7; 451/41; 451/288; 451/287; 451/6

(58) Field of Search ..... 451/7, 10, 6, 21, 451/9, 41, 449, 56, 285–289, 450, 14, 17, 550, 307, 8; 156/626.1

(56) References Cited

U.S. PATENT DOCUMENTS

| | | | | | |
|---|---|---|---|---|---|
| 3,643,045 | A | | 2/1972 | Beck | 200/47 |
| 3,694,800 | A | | 9/1972 | Frank | 340/1 R |
| 3,815,994 | A | | 6/1974 | Peckham | 356/4 |
| 3,885,872 | A | | 5/1975 | Howe, Jr. et al. | 356/4 |
| 3,899,251 | A | | 8/1975 | Frenk et al. | 356/28 |
| 3,918,296 | A | | 11/1975 | Kitada | 73/67.7 |
| 4,175,441 | A | | 11/1979 | Urbanek et al. | 73/599 |
| 4,285,053 | A | | 8/1981 | Kren et al. | 367/99 |
| 4,639,140 | A | | 1/1987 | Lerat | 356/376 |
| 4,657,382 | A | | 4/1987 | Busujima et al. | 356/4 |
| 4,673,817 | A | | 6/1987 | Oomen | 250/561 |
| 4,865,443 | A | | 9/1989 | Howe et al. | 356/4 |
| 5,035,087 | A | * | 7/1991 | Nishiguchi et al. | 51/131.1 |
| 5,056,913 | A | | 10/1991 | Tanaka et al. | 356/4 |
| 5,131,740 | A | | 7/1992 | Maekawa | 356/1 |
| 5,439,551 | A | * | 8/1995 | Meikle et al. | 156/626.1 |
| 5,643,059 | A | | 7/1997 | Chen | 451/164 |
| 5,825,481 | A | | 10/1998 | Alofs et al. | 356/138 |
| 5,827,111 | A | * | 10/1998 | Ball | 451/14 |
| 5,827,112 | A | * | 10/1998 | Ball | 451/21 |
| 5,852,232 | A | | 12/1998 | Samsavar et al. | 73/105 |
| 5,882,244 | A | * | 3/1999 | Hiyama et al. | 451/41 |
| 6,190,234 | B1 | * | 2/2001 | Swedek et al. | 451/6 |
| 6,254,459 | B1 | * | 7/2001 | Bajaj et al. | 451/41 |
| 6,354,914 | B1 | * | 3/2002 | Inaba et al. | 451/41 |

* cited by examiner

*Primary Examiner*—Lee Wilson
(74) *Attorney, Agent, or Firm*—Dorsey & Whitney LLP

(57) ABSTRACT

Apparatus and methods of automated wafer-grinding using grinding surface position monitoring. In one embodiment, an apparatus for grinding a working surface includes a grinding surface engageable with at least a portion of the working surface, and a feed mechanism that controllably adjusts a position of the grinding surface. The apparatus further includes a position sensor that senses a position of the grinding surface along an axis approximately normal to the working surface and a controller that receives a position signal from the position sensor and transmits a control signal to the feed mechanism in response to the position signal. In alternate embodiments, the position sensor may be an acoustic sensor, an optical sensor, or another type of sensor. The grinding surface may include a grinding material suspended in a binder, the grinding material being worn during grinding. In an alternate embodiment, an apparatus further includes a supplemental sensor that senses an operating characteristic and outputs a characteristic signal. The controller receives the characteristic signal and transmits the control signal to the feed mechanism based on at least one of the position signal or the characteristic signal. In alternate embodiments, the characteristic signal may include a pressure of the grinding surface on the working surface, a shaft speed of a drive shaft, or a current drawn by a drive motor.

31 Claims, 4 Drawing Sheets

APPARATUS AND METHODS OF AUTOMATED WAFER-GRINDING USING GRINDING SURFACE POSITION MONITORING

TECHNICAL FIELD

The present invention relates to apparatus and methods of automated wafer-grinding of semiconductor wafers, and more particularly to automatically grinding by monitoring a grinding parameter.

BACKGROUND OF THE INVENTION

The source material for manufacturing semiconductor chips is usually a relatively large wafer of silicon. Such wafers may be produced by slicing a silicon crystal ingot to a suitable thickness to obtain a number of nearly disk-shaped semiconductor wafers. Both surfaces of each wafer are subjected to abrasive machining, and then etched in a suitable mixed acid solution. One surface of each wafer is then polished to obtain a mirror surface. Circuits are fabricated in the mirror surface of the resulting semiconductor wafer by known processing steps, such as, for example, printing, etching, diffusion, or doping.

When the silicon wafers are sliced from the crystal ingot, the thickness of the wafers is usually greater than desirable for a finished integrated circuit product so as to provide a more robust wafer to stand up to the rigors of the integrated circuit fabrication process. Relatively thick silicon wafers may be necessary, for example, during certain integrated circuit fabrication steps to prevent warpage and breakage of the wafer as a result of heating, handling, and other circuit fabrication processes. Because the thickness of the wafer after the circuit fabrication process is usually greater than desirable for device packaging restrictions, it is typically necessary to grind a backside surface of the wafer opposite from the surface on which the integrated circuits are formed to reduce the wafer thickness.

Automated grinding machines for grinding the backside surfaces of wafers are known. Conventional grinding machines generally include a plurality of chuck tables that secure a plurality of wafers to be ground by one or more grinding wheels. A conventional grinding wheel typically includes a plurality of diamonds embedded in a resinous binder, with some of the diamonds exposed and some unexposed. As the grinding progresses, the exposed diamonds wear down to the level of the binder. The binder is selected to erode during grinding to expose fresh diamonds. The rate of wear of the grinding wheel may be dependent on the composition of the binder, the grinding rate, or other factors, as described more fully below.

FIG. 1 is a side elevational view of an automated grinding machine 10 for grinding a backside surface 25 of a wafer 12 in accordance with the prior art. The grinding machine 10 includes a spindle housing 14 disposed about a spindle 16 having a rotatable grinding shaft 18. A grinding wheel 20 is rigidly secured to the end of the shaft 18. A spindle motor 22 rotates the shaft 18 and the grinding wheel 20 at conventional speeds of 2400–3200 RPM during the grinding process, causing the grinding wheel 20 to grind away semiconductor material from the backside surface 25 of the wafer 12. The spindle housing 14 is coupled to a feed mechanism 26 that allows the placement and the feed rate of the grinding wheel 20 to be adjusted relative to the wafer 14 to provide, for example, different grinding rates.

A controller 27, such as a computer, is electrically connected to the grinding wheel 20 by electrical conductor 29 to receive feedback signals, and to a feed rate motor 31 by electrical conductor 33 to send control signals thereto. The controller 27 is also connected to a shaft speed sensor 19 by electrical conductor 35, to a spindle motor current detector 21 by electrical conductor 37, and to the spindle motor 22 by electrical conductor 23. The wafer 12 is secured to a chuck table platform 30 of a chuck table 28 by a suitable securing mechanism, such as vacuum suction, with the front side of the wafer 12 that includes the integrated circuits positioned against the chuck table platform 30. The chuck table platform 30 is secured to a shaft 32 which is driven by a chuck table motor (not shown) at conventional speeds of between 50–300 RPM.

FIG. 2 is a bottom plan view of the grinding wheel 20 of the grinding machine 10 of FIG. 1. FIG. 3 is a partial cross-sectional radial view of the grinding wheel 20 of FIG. 2. As shown in FIGS. 2 and 3, the grinding wheel 20 includes a disk portion 40 and an annular shoulder 42 depending downwardly from the peripheral edge 41 of the disk portion 40. The annular shoulder 42 includes a lower surface 47. A plurality of cylindrical cavities 44 are formed in the lower surface 47 of the annular shoulder 42 and a cylindrical grinding tooth 46 is disposed in each cavity 44. Each cavity 44 is connected to a central shaft-receiving bore 43 by a pressure signal transmission pathway 45.

As best shown in FIG. 3, each grinding tooth 46 includes a body 48 having a first end 50, which includes a grinding surface 24, and a second end 52. The second end 52 is disposed in the cavity 44. A pressure sensor 54 is disposed in the cavity 44 between the second end 52 and the disk portion 40. The pressure sensors 54 may include, for example, a piezoelectric element 60 that produces an electrical voltage when it is squeezed. Thus, the pressure sensor 54 may convert mechanical pressure on the grinding teeth 46 into an electrical signal, the strength of which increases or decreases with the pressure exerted by the grinding wheel 20 against the backside surface 25 of the wafer 12. The grinding surface 24 may include a plurality of diamonds suspended in a resinous binder. As disclosed, for example, in U.S. Pat. No. 5,827,112 to Ball, incorporated herein by reference, the binder may be selected to be reactive with wheel dressing and to dissolve, either mechanically, or chemically or both. As the binder dissolves, the dull diamonds from the grinding surface 24 are released and washed away, leaving freshly exposed sharp diamonds.

The controller 27 may receive input signals from the pressure sensors 54 to indicate the pressure exerted by the grinding wheel 20 against the wafer 12. The controller 27 may also receive input signals from the speed sensor 19 indicative of the rotational speed of the shaft 18, and input signals from the current detector 21 which indicate the amount of current being drawn by the spindle motor 22. Based on these input signals, the controller 27 may adjustably control various operating parameters of the automated grinding machine 10, including, for example, the feed rate of the feed rate motor 31, the rotational speed of the spindle motor 22, or the release of wheel dressing for sharpening the grinding wheel 20.

FIG. 4 is a schematic view of a typical grind recipe 80 of a grinding machine 10 in accordance with the prior art. During the grinding process shown in FIG. 4, the grinding wheel 20 descends along a z-axis as a function of time t (shown as the horizontal axis in FIG. 4), allowing the grinding teeth 46 to grind away the backside surface 25 of the wafer 12. During a first or "rapid descent" phase 82, the grinding wheel 20 maintains a relatively high rate of descent between times $t_0$ and $t_1$. During a second or "F1 removal"

phase 84, the rate of descent of the grinding wheel 20 is decreased (typically 40 microns per minute) between times $t_1$ and $t_2$. Finally, during a third or "F2 removal" phase 86, the rate of descent of the grinding wheel 20 is further decreased (typically 20 microns per minute) between times $t_2$ and $t_3$. Thus, in the representative grind recipe 80, the time required to remove a wafer layer of thickness $z_0$–$z_3$ is the time $t_3$–$t_0$. The times $t_1$, $t_2$, and $t_3$ are typically selected to avoid stress cracks or other defects in the wafer 12.

In addition to descent rate of the grinding wheel, other operating conditions of the grinding machine 10 may be varied during the phases 82, 84, 86. For example, the rotational rate of the grinding wheel may be varied, or different grinding wheels having grinding surfaces with different diamond sizes may be used. Grinding machines 10 having grind recipes of the type shown in FIG. 4 typically process approximately 35 wafers per hour.

Various grinding machines have been disclosed to control the forces applied to the wafer. For example, U.S. Pat. No. 5,035,087 to Nishiguchi et al discloses a grinding machine that compares the shaft motor current and a rotation speed of the shaft with predetermined values to derive actual and desired grinding resistance values. The shaft speed is adjusted to bring the actual grinding resistance value closer to the desired value. U.S. Pat. No. 5,545,076 to Yun et al discloses an apparatus for removing dust from a wafer during the grinding process includes a controller for controlling the grinding device and cleaning device. U.S. Pat. No. 5,607,341 to Leach discloses an apparatus for polishing the wafer having a plurality of blocks that move up and down in a grinding wheel. A magnetic fluid is contained in the grinding wheel and cooperates with a magnet disposed below the wafer to apply a force to the blocks. Thus, various methods are known for controlling the grinding force exerted by the grinding wheel 20 on the wafer 12, thereby controlling the grinding rate.

Prior to commencing a grinding procedure, a calibration may be performed with the wafer 12 removed from the chuck table platform 30. The feed mechanism 26 may lower the grinding wheel 20 until the grinding surfaces 24 (FIG. 3) of the grinding wheel 20 contact the chuck table platform 30, providing a "zero" or reference position along the z axis (FIG. 1) which may be stored, for example, in a memory of the controller 27. As the grinding wheel 20 is raised, a series of measurements of the distance between the grinding surfaces 24 and the chuck table platform 30 may be made and entered into the controller 27 to create a database of measured calibration data in the memory of the controller 27. Thus, based on a given position of the feed mechanism 26, the controller 27 may determine a "predicted" position of the grinding surfaces 24 of the grinding wheel 20 based on the measured calibration database.

Because the grinding surfaces 24 wear during the grinding process, the predicted position of the grinding surfaces 24 based on the measured calibration data may not accurately reflect the true position of the grinding surfaces 24, particularly after the grinding surfaces 24 have been used for an extended period of time. Generally, the longer the grinding wheel 20 is used, the greater may be the discrepancy between the predicted position of the grinding surfaces 24 determined from the measured calibration data, and the actual position of the grinding surfaces 24. The discrepancy between the predicted and actual positions of the grinding surfaces 24 results in uncertainty over the true thickness of the wafer 12 during the grinding process. For thick wafers, however, the uncertainty over the true thickness of the wafer 12 may be negligible. Alternately, the grinding process may be repeatedly interrupted to manually measure the actual thickness of the wafer 12 until a desired wafer thickness is achieved.

Although desirable results have been achieved using the above-described grinding machines and grinding procedures, the ever-increasing demands of the semiconductor industry for reducing the size of semiconductor chip assemblies are placing unprecedented demands on such machines and procedures to be more accurate. For example, decreasing the size of semiconductor chip assemblies requires decreasing the thickness of the wafer. As wafer thickness is reduced, increased requirements are placed on the grinding machine to more accurately determine the thickness of the wafer and to more accurately control the grinding rate of the grinding wheel 20 against the backside surface 25 of the wafer 12. As wafer thickness is decreased, extra care must be taken to ensure that the wafer is not over-ground or made too thin.

Furthermore, because thinner wafers are more prone to stress cracking or breakage due to the pressure from the grinding wheel, the descent rate of the grinding wheel must be more carefully controlled to avoid damaging thinner wafers. The uncertainty over the actual thickness of the wafer due to the wear of the grinding surfaces may become more important as the wafer thickness is decreased, and may require more frequent interruptions of the wafer grinding process to measure the actual thickness of the wafer. The grinding process is thereby slowed, and the throughput of the manufacturing process is reduced.

SUMMARY OF THE INVENTION

The present invention is directed to apparatus and methods of automated wafer-grinding using grinding surface position monitoring. In various aspects of the invention, grinding surface position monitoring may include, for example, monitoring acoustic or optical signals reflected (or through-beam or electrically or magnetically coupled) from the grinding surface, and may be used in combination with monitoring of other operating characteristics, such as grind pressure, shaft speed, or current drawn by a drive motor. Apparatus and methods according to the invention provide improved accuracy and increased throughput of the grinding process.

In one aspect, an apparatus for grinding a working surface includes a grinding surface engageable with at least a portion of the working surface, and a feed mechanism that controllably adjusts a position of the grinding surface. The apparatus further includes a position sensor that senses a position of the grinding surface along an axis approximately normal to the working surface and a controller that receives a position signal from the position sensor and transmits a control signal to the feed mechanism in response to the position signal. In alternate aspects, the position sensor may be an acoustic sensor, an optical sensor, or another type of sensor. The grinding surface may include a grinding material suspended in a binder, the grinding material being worn during grinding.

In an alternate aspect, an apparatus further includes a supplemental sensor that senses an operating characteristic and outputs a characteristic signal. The controller receives the characteristic signal and transmits the control signal to the feed mechanism based on at least one of the position signal or the characteristic signal. In alternate aspects, the characteristic signal may include a pressure of the grinding surface on the working surface, a shaft speed of a drive shaft, a current drawn by a drive motor, or some other parameter.

DETAILED DESCRIPTION OF THE INVENTION

The present invention is generally directed to apparatus and methods of automated wafer-grinding using grinding surface position monitoring. Grinding surface position monitoring may include, for example, monitoring acoustic or optical signals reflected from the grinding surface, and may be used in combination with monitoring of other operating characteristics, such as grind pressure, shaft speed, or current drawn by a drive motor. Apparatus and methods according to the disclosed embodiment of the invention provide improved accuracy and increased throughput of the grinding process.

Many specific details of certain embodiments of the invention are set forth in the following description and in FIGS. 5–7 to provide a thorough understanding of such embodiments. One skilled in the art will understand, however, that the present invention may have additional embodiments, or that the present invention may be practiced without several of the details described in the following description.

Unless otherwise stated, the construction and operation of various components of the embodiments described below may be of conventional design. Such components will be referred to using the same names and designation numbers as were used in the preceding discussion. For the sake of brevity, such components will not be described in further detail herein, as these components are within the understanding of those skilled in the relevant art.

Figure 5:
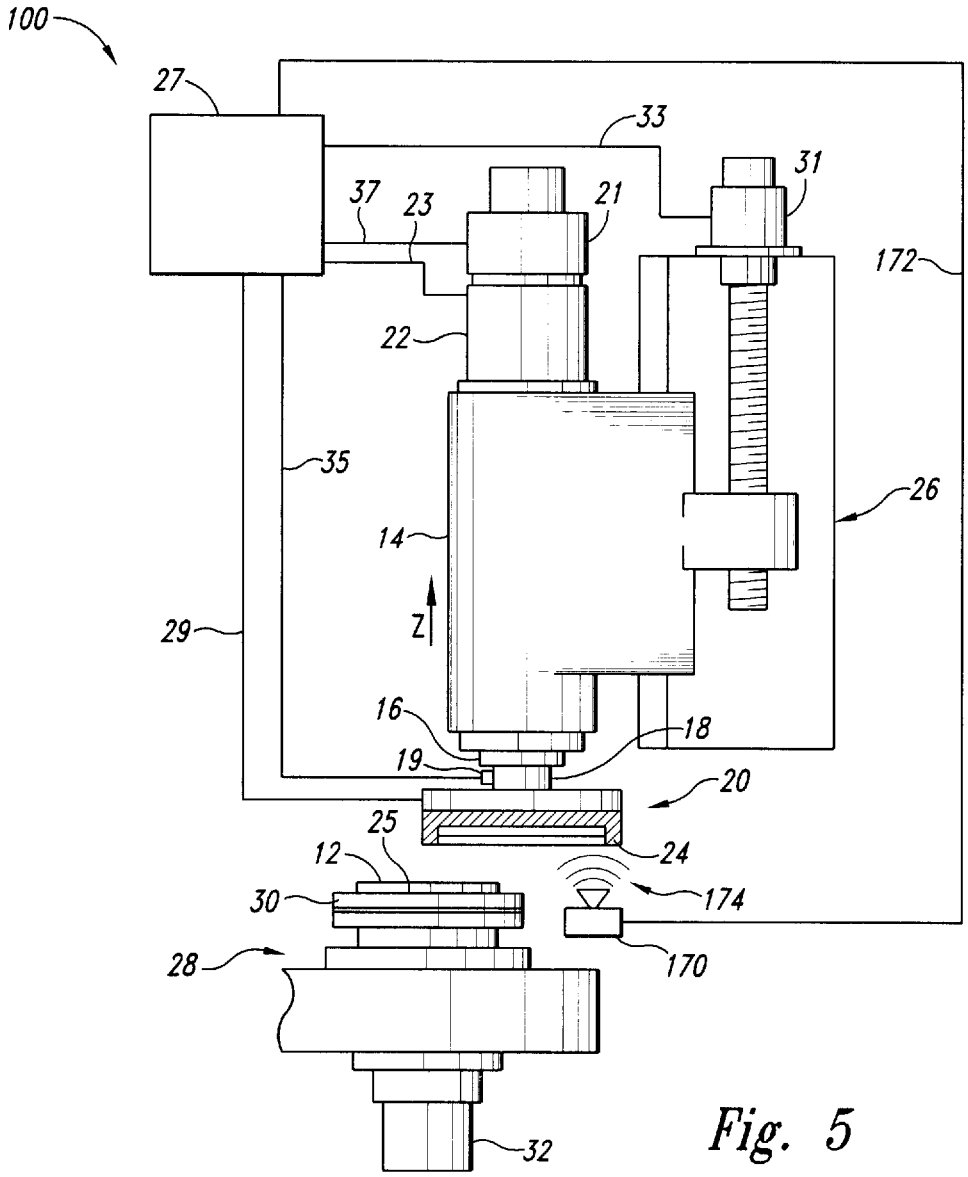
FIG. 5 is a side elevational view of an automated grinding machine having an acoustic sensor in accordance with an embodiment of the invention.

FIG. 5 is a side elevational view of an automated grinding machine 100 having an acoustic sensor 170 in accordance with an embodiment of the invention. The acoustic sensor 170 is positioned proximate the grinding wheel 20 and is coupled to the controller 27 by a signal lead 172. As shown in FIG. 5, the acoustic sensor 170 transmits one or more acoustic signals 174 toward the grinding wheel 20.

Figure 6:
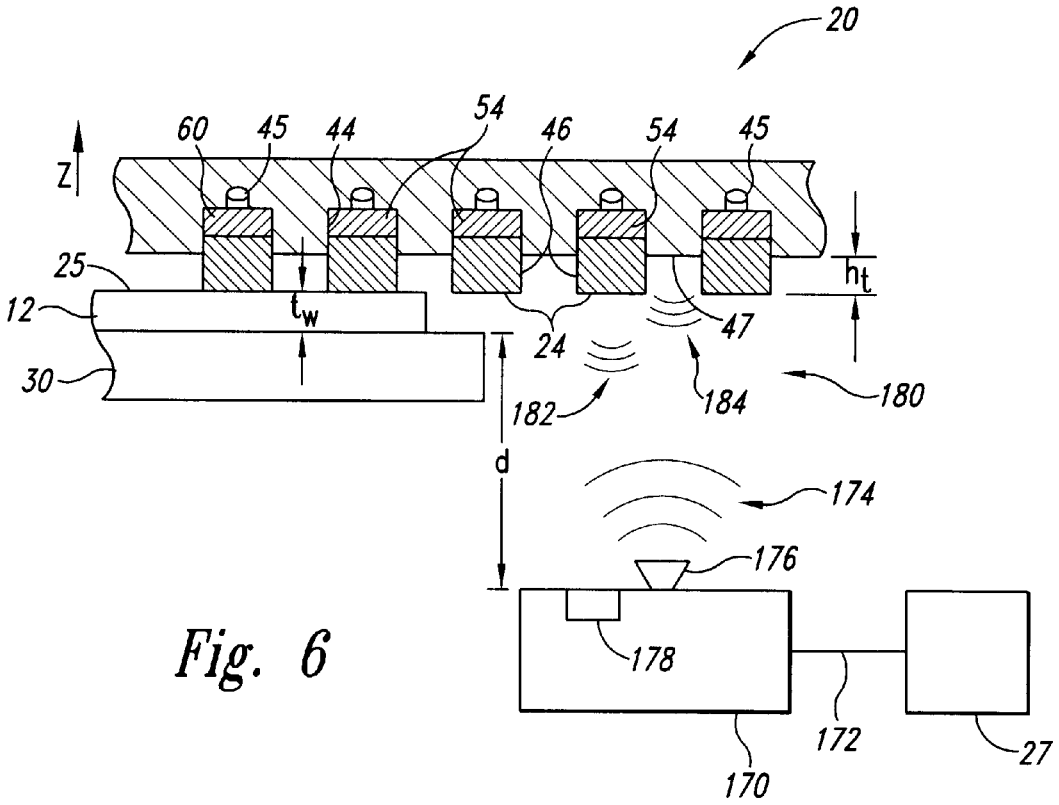
FIG. 6 is an enlarged, partial cross-sectional radial view of the grinding wheel and the acoustic sensor of the grinding machine of FIG. 5.
Figure 7:
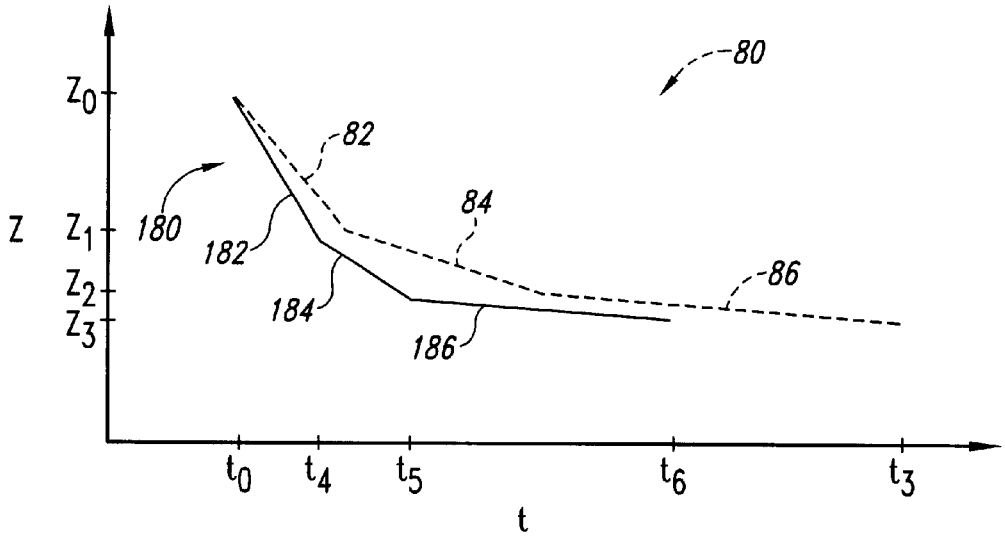
FIG. 7 is a schematic view of a grind recipe of the grinding machine of FIG. 6 compared with the typical grind recipe of FIG. 4.

FIG. 6 is an enlarged, partial cross-sectional radial view of the grinding wheel 20 and the acoustic sensor 170 of the grinding machine 100 of FIG. 5. In this embodiment, the acoustic sensor 170 includes an acoustic source 176 that transmits the acoustic signals 174, and an acoustic receiver 178 that receives reflected acoustic signals 180 from the grinding wheel 20. The reflected acoustic signals 180 may include first reflected signals 182 that reflect from the grinding surfaces 24 of the grinding teeth 46, and second reflected signals 184 that reflect from the lower surface 47 of the grinding wheel 20 at the base of the grinding teeth 46.

The acoustic sensor 170 may be any suitable type of acoustic sensor that determines position of an object based on transmitted and reflected acoustic signals. For example, the acoustic sensor 170 may be one of the sensor types disclosed in U.S. Pat. No. 5,852,232 issued to Samsavar et al, U.S. Pat. No. 4,285,053 issued to Kren et al, U.S. Pat. No. 4,175,441 issued to Urbanek et al, U.S. Pat. No. 3,918,296 issued to Kitada, or U.S. Pat. No. 3,694,800 issued to Frank, which patents are incorporated herein by reference. Generally, acoustic position sensors may transmit an acoustic signal toward an object and receive a reflected acoustic signal from the object, and may determine a distance to the object based on a time measured between the transmitted and received acoustic signals and a known or assumed speed of sound. Alternately, the distance may be inferred from measured interference patterns in the transmitted and received acoustic waves, or by other suitable means, as disclosed, for example, in the above-referenced patents.

It will be understood that the acoustic sensor 170 may be replaced with any suitable position sensing apparatus, such as optical or electromagnetic sensors, including those which sense the position of an object using visible, ultraviolet, or infrared light. For example, the acoustic sensor 170 may be replaced by one of the optical sensor types disclosed in U.S. Pat. No. 5,825,481 issued to Alofs et al, U.S. Pat. No. 5,131,740 issued to Maekawa, U.S. Pat. No. 5,056,913 issued to Tanaka et al, U.S. Pat. No. 4,865,443 issued to Howe et al, U.S. Pat. No. 4,639,140 issued to Lerat, U.S. Pat. No. 4,673,817 issued to Oomen, U.S. Pat. No. 4,657,382 issued to Busujima et al, U.S. Pat. No. 3,899,251 issued to Frenk et al, U.S. Pat. No. 3,885,872 issued to Howe et al, or U.S. Pat. No. 3,815,994 issued to Peckham, which patents are incorporated herein by reference. In the following discussion, for the sake of brevity, the position sensor will be described as an acoustic sensor 170 although it will be understood that any type of position sensing apparatus may be employed.

Figure 1:
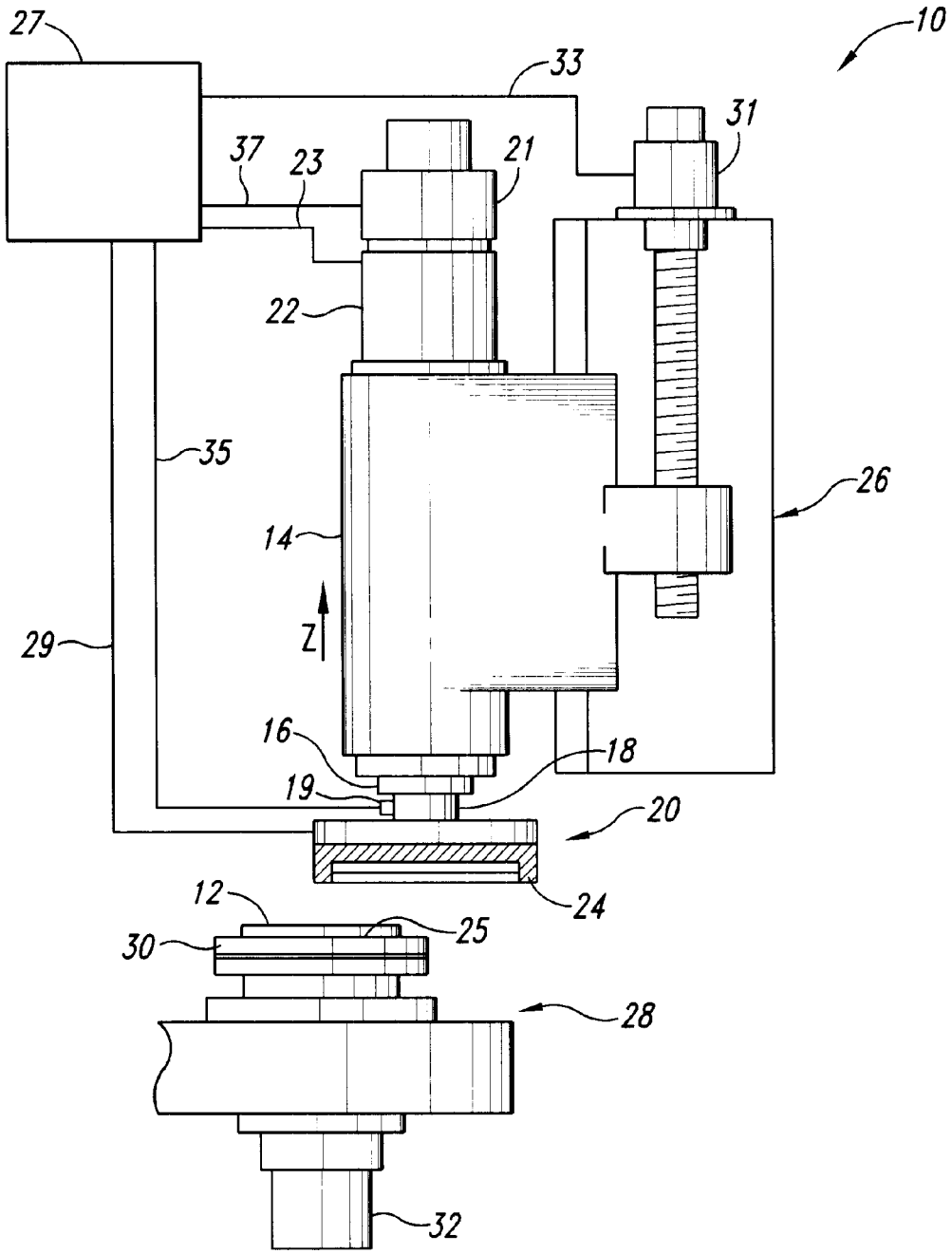
Fig. 1 (Prior Art)
FIG. 1 is a side elevational view of an automated grinding machine in accordance with the prior art.
Figure 2:
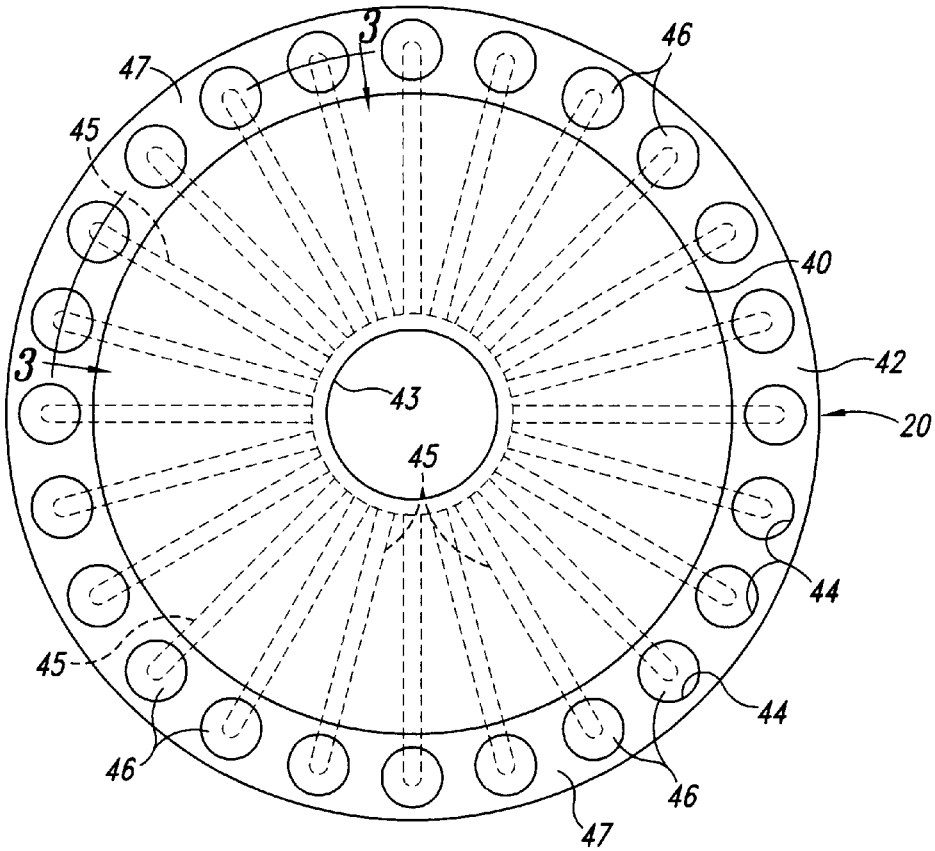
Fig. 2 (Prior Art)
FIG. 2 is a bottom plan view of a grinding wheel of the grinding machine of FIG. 1.
Figure 3:
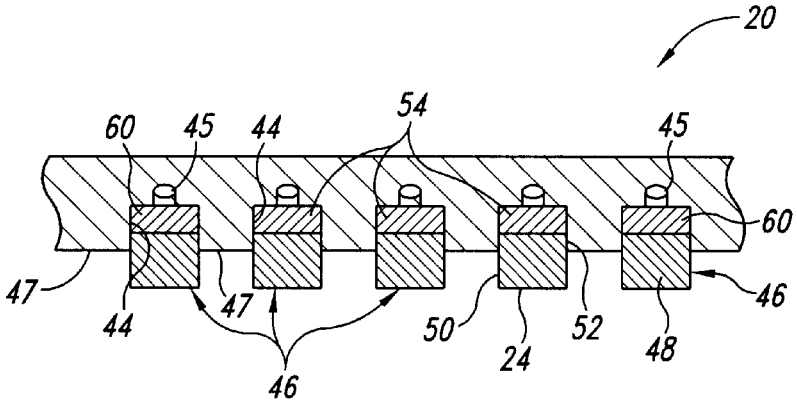
Fig. 3 (Prior Art)
FIG. 3 is an enlarged, partial cross-sectional radial view of the grinding wheel of FIG. 2.

The automated grinding machine 100 having the acoustic sensor 170 may be operated in a variety of ways to provide desirable results, including to provide improved grinding accuracy, increased throughput, and to monitor the wear of the grinding surfaces 24 during operation of the machine. For example, in one embodiment, a method of operating the grinding machine 100 includes performing a calibration procedure with the wafer 12 removed from the chuck table platform 30 prior to commencing a grinding procedure. The feed mechanism 26 may lower the grinding wheel 20 until the grinding surfaces 24 (FIG. 3) of the grinding wheel 20 contact the chuck table platform 30, providing a "zero" or reference position along the z axis (FIG. 5) which may be stored, for example, in a memory of the controller 27. As the grinding wheel 20 is raised, a series of measurements of the distance between the grinding surfaces 24 and the chuck table platform 30 may be made and entered into the controller 27 to create a database of measured calibration data in the memory of the controller 27. Thus, based on a given position of the feed mechanism 26, the controller 27 may determine a "predicted" position of the grinding surfaces 24 of the grinding wheel 20 based on the measured calibration database.

Alternately, in the same or another calibration procedure, a different set of "predicted" grinding surface positions may be created using the acoustic sensor 170. For example, the acoustic sensor 170 may be operated to transmit acoustic signals 174 toward the grinding wheel 20 and may receive the reflected acoustic signals 180 (either the first or second reflected signals 182, 184, or both). Based on the first reflected signals 182, and using known acoustic signal processing techniques, a series of first position measurements of the grinding surfaces 24 may be determined by the acoustic sensor 170 and may be entered into the controller 27 to form a first calibration database. Similarly, based on the second reflected signals 184, a series of second position measurements of the lower surface 47 of the grinding wheel 20 may be determined by the acoustic sensor 170 and may be entered into the controller 27 to form a second calibration database.

In operation, the grinding wheel 20 of the grinding machine 100 may be raised to a starting position and the wafer 12 may be positioned on the chuck table platform 30 for grinding. As the rotating grinding wheel 20 descends toward the wafer 12, the acoustic sensor 170 may be used to transmit acoustic signals 174 onto the grinding surfaces 24 and to receive the first reflected acoustic signals 182. Based on known signal processing techniques (described in the above-referenced patents), an "actual" position of the grinding surfaces 24 during the grinding operation may be determined.

As described more fully below, by determining the "actual" position of the grinding surfaces 24 during operation of the grinding machine 100, the wafer thickness $t_w$ during the grinding process may be accurately determined and controlled. Also, by comparing the "actual" position with the "predicted" position of the grinding surfaces 24, the wear of the grinding surfaces 24 may be monitored during the grinding operation. Finally, because the wear of the grinding surfaces 24 may be monitored during operation, downtime of the grinding machine 100 may be reduced and the throughput of the grinding process may be improved.

One may note that the first and second calibration databases need not be created, and the acoustic sensor 170 may simply be operated without calibration data during a grinding procedure to determine the distance from the acoustic sensor 170 to the grinding wheel 20 (either distance to the grinding surfaces 24 or to the lower surface 47, or both). If the acoustic sensor 170 is not positioned at the reference position (i.e. at the same plane as the chuck table platform 300), then a reference distance d as shown in FIG. 6 may be determined, such as during a calibration procedure, and stored, for example, in the controller 27.

In yet another alternate method of operation, the grinding wheel 20 of the grinding machine 100 may be raised to a starting position and the wafer 12 may be positioned on the chuck table platform 30 for grinding. As the rotating grinding wheel 20 descends toward the wafer 12, the controller 27 may monitor a first characteristic of the grinding machine 100. The first characteristic may include, for example, a pressure signal from the pressure sensors 54, a shaft speed signal from the shaft speed sensor 19, a current drawn by the drive motor 22, or some other operating characteristic of the grinding machine 100. Similarly, the acoustic sensor 170 transmits acoustic signals 174 and receives reflected acoustic signals 180 which may be received by the acoustic sensor 170 and processed by the acoustic sensor 170 or the controller 27 to provide an actual position of the grinding surfaces 24 of the grinding wheel 20. The grinding wheel 20 continues to descend until the grinding surfaces 24 of the grinding teeth 46 engage with the backside surface 25 of the wafer 12.

Based on the monitored first characteristic, the controller 27 may determine the point at which the grinding teeth 46 engage the backside surface 25. For example, if the first characteristic is a pressure signal from the pressure sensors 54, the controller 27 may detect an increase in the pressure signal when the grinding surfaces 24 engage the wafer 12. Similarly, if the first characteristic is a current signal indicating a current drawn by the drive motor 22, the controller 27 may detect an increase in the current drawn by the drive motor 22 when the grinding surfaces 24 engage the wafer 12 as the drive motor 22 draws more current to maintain the rotational rate of the grinding wheel 20. If the first characteristic is a shaft speed signal, the controller 27 may detect a decrease in the shaft speed as the grinding surfaces 24 engage the wafer 12.

During a grinding operation, the grinding surfaces 24 wear down, decreasing the distance between the grinding surfaces 24 and the lower surface 47, denoted as tooth height $h_t$ in FIG. 6. To monitor the tooth height $h_t$, the acoustic sensor 170 transmits acoustic signals 174 toward the grinding wheel 20 and receives the first reflected signals 182 (which reflect from the grinding surfaces 24) and the second reflected signals 184 (which reflect from the lower surface 47). The acoustic sensor 170 may then process the first and second reflected signals 182, 184 to determine the distances between the acoustic sensor 170 and the grinding and lower surfaces 24, 47, respectively. From this information, the acoustic sensor 170 may determine the tooth height $h_t$. Alternately, the acoustic sensor 170 may simply receive the first and second reflected signals 182, 184 and may transmit signals indicative of having received the first and second reflected signals 182, 184 to the controller 27. The controller 27 may then perform the necessary processing to determine the height $h_t$ of the grinding teeth 46.

One may note that in alternate embodiments, grinding surface position monitoring may be accomplished by varying the above-described methods. For example, the acoustic or optical signals which are monitored to determine the position of the grinding surface need not be reflected signals, but rather, by proper orientation of the sensor (or the use of additional sensors), position sensing may be accomplished by through-beam sensing, or may be accomplished via electrical or magnetic coupling.

The acoustic sensor 170 advantageously permits the grinding machine 100 to monitor tooth height $h_t$ during grinding operations, the actual position of the grinding surfaces 24 may be determined at all times during the grinding process. This reduces or eliminates the need to shut down the grinding machine 100 to manually measure and determine the wear of the grinding teeth 46 until the grinding surfaces 24 are worn out. Because measurement of the tooth height $h_t$ may be performed rapidly and accurately using the acoustic sensor 170, the need for labor-intensive manual measurement of the tooth height $h_t$ may be eliminated, and down time of the grinding machine 100 may be reduced. Also, because accurate information regarding the tooth height $h_t$ may be constantly available during the grinding process, the life of the grinding wheel 20 may be optimized.

Because the actual position of the grinding surfaces 24 is determined using the acoustic sensor 170, the actual wafer thickness $t_w$ during the grinding process may be determined. The controller 27 may also utilize the reference distance d (FIG. 6) in determining the actual position of the grinding surfaces 24, and thus, the actual wafer thickness $t_w$. Based on the actual position of the grinding surfaces 24, the controller 27 may adjustably control the feed mechanism 26 to accurately grind the wafer 12 to a desired wafer thickness $t_w$.

Because the acoustic sensor 170 may be used during the grinding process to determine the actual position of the grinding surfaces 24, the grinding apparatus 100 may provide improved control over the wafer thickness $t_w$. Thus, over-grinding of the wafer 12 may be avoided. Also, the descent rate of the grinding wheel 20 may be more carefully controlled as the wafer thickness $t_w$ decreases to avoid causing stress fractures within the wafer 12.

Figure 4:
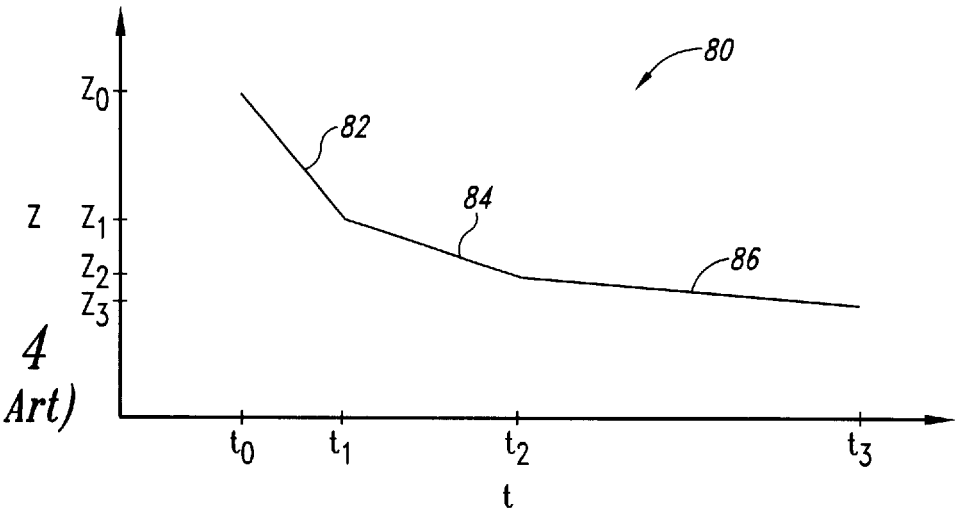
Fig. 4 (Prior Art)
FIG. 4 is a schematic view of a typical grind recipe of a grinding machine in accordance with the prior art.

Another advantage of the grinding machine 100 having the acoustic sensor 170 is that the grinding recipe may be more optimally designed. For example, FIG. 7 is a schematic view of a grind recipe 180 of the grinding machine 100 compared with the typical grind recipe 80 of FIG. 4. As shown in FIG. 7, the grind recipe 180 includes a rapid descent phase 182, an F1 removal phase 184, and an F2 removal phase 186. In addition to descent rate, other operating conditions of the grinding machine 100 may be varied during the phases 182, 184, 186. For example, the rotational rate of the grinding wheel 20 may be varied, or different grinding wheels having grinding surfaces with different diamond sizes may be used.

Because the acoustic sensor 170 allows the wafer thickness $t_w$ to be accurately monitored during the grinding process, the grinding machine 100 may employ a more aggressive grind recipe 180 compared with the typical grind recipe 80 of the prior art. Thus, in the grind recipe 180 shown in FIG. 7, the rates of descent of the grinding wheel 20 during the phases 182, 184, 186 are greater than the comparable rates of descent of the prior art grind recipe 80. Because the grind recipe 180 of the grinding machine 100 may be more aggressive (i.e. faster descent rates) than the prior art grind recipe 80, the time required to remove a wafer layer of thickness $z_0$–$z_3$ is the time $t_6$–$t_0$, which may be substantially shorter than the time required ($t_3$–$t_0$) using the prior art grind recipe 80. Thus, the grinding machine 100 having the acoustic sensor 170 may advantageously reduce the grinding time cycle, and may desirably increase the throughput of the manufacturing process. For example, the grinding machine 100 operating according to the grinding recipe 180 may produce approximately 50 wafers per hour, or more.

It may be noted that the above-described apparatus and methods of automated wafer-grinding using grinding surface position monitoring may be used to accurately grind a variety of semiconductor components and materials, and not just the silicon wafer materials specifically described above. The inventive apparatus and methods disclosed herein may be applied to automated grinding processes for grinding a variety of materials and components in which accurate control of material thickness is desired, such as other semiconductor substrates, metallic layers, insulative layers and the like. Furthermore, embodiments of the invention are not limited to grinding devices having rotatable grinding surfaces, but may with equal success have other grinding surface motion, including reciprocating grinding surfaces such as those disclosed, for example, in U.S. Pat. No. 5,643,059 issued to Chen, and U.S. Pat. No. 3,643,045 issued to Beck, which patents are incorporated herein by reference. Therefore, the apparatus and methods disclosed herein should not be limited to the particular embodiments or to the particular application of grinding silicon wafers described above.

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein can be applied to other apparatus and methods of directed to apparatus and methods of automated wafer-grinding using grinding surface position monitoring, and not just to the embodiments described above and shown in the accompanying figures. Accordingly, the scope of the invention should be determined from the following claims.

What is claimed is:

1. An apparatus for grinding a working surface, comprising:

a moveable grinding surface engageable with at least a portion of the working surface;

a feed mechanism coupled to the grinding surface that receives a control signal and controllably adjusts a position of the grinding surface;

a position sensor that senses a position of the grinding surface by transmitting a sensing signal toward the grinding surface, and receiving a reflected sensing signal from the grinding surface, the position sensor outputting at least one of the reflected sensing signal and a position signal; and a controller that receives the at least one of the reflected sensing signal and the position signal and transmits the control signal to the feed mechanism in response to the position signal.

2. The apparatus according to claim 1 wherein the position sensor comprises an acoustic sensor.

3. The apparatus according to claim 1 wherein the position sensor comprises an optical sensor.

4. The apparatus according to claim 1, further comprising a grinding head having a lower surface and a grinding tooth attached to the lower surface, the grinding surface being disposed on the grinding tooth.

5. The apparatus according to claim 4 wherein the reflected sensing signal comprises a first reflected signal, and wherein the position sensor further receives a second reflected signal, the second reflected signal being a reflection of the sensing signal from the lower surface, the position sensor outputting at least one of the first reflected signal, the second reflected signal, and a tooth height signal indicating a height of the grinding tooth above the lower surface.

6. The apparatus according to claim 1 wherein the grinding surface includes a grinding material suspended in a binder, the grinding material having a plurality of diamonds, a first portion of the plurality of diamonds being exposed for grinding and a second portion of the plurality of diamonds being unexposed, the exposed diamonds being worn during grinding.

7. The apparatus according to claim 1, further comprising a supplemental sensor that senses an operating characteristic of the grinding surface and outputs a characteristic signal, and wherein the controller receives the characteristic signal and transmits the control signal to the feed mechanism based on at least one of the position signal and the characteristic signal.

8. The apparatus according to claim 7 wherein the supplemental sensor comprises a pressure sensor and the operating characteristic comprises a pressure of the grinding surface on the working surface.

9. The apparatus according to claim 7 wherein the grinding surface comprises a grinding wheel, further comprising a drive shaft coupled to the grinding wheel, and wherein the supplemental sensor comprises a shaft speed sensor and the operating characteristic comprises a shaft speed of the drive shaft.

10. The apparatus according to claim 7, further comprising a motor coupled to the grinding surface, and wherein the supplemental sensor comprises a current sensor and the operating characteristic comprises a current drawn by the motor.

11. An apparatus for grinding a wafer, comprising:

a grinding wheel including a grinding surface engageable with at least a portion of the wafer;

a rotatable shaft coupled to the grinding wheel;

a drive motor coupled to the shaft;

a feed mechanism coupled to the shaft that receives a control signal and controllably adjusts a position of the grinding surface normal to the surface of the wafer;

a first sensor that senses a first operating characteristic of the grinding wheel and outputs a first signal;

a position sensor that senses the position of the grinding surface normal to the surface of the wafer by transmitting a sensing signal toward the grinding surface, and receiving a reflected sensing signal from the grinding surface, the position sensor outputting at least one of the reflected sensing signal and a position signal corresponding to a position of the grinding surface; and a controller that receives the first signal and the at least one of the reflected sensing signal and position signal and transmits the control signal to the feed mechanism in response to a combination of the first and the at least one of the reflected sensing signal and the position signals.

12. The apparatus according to claim 11 wherein the first sensor comprises a pressure sensor and the first characteristic comprises a pressure of the grinding surface on the wafer.

13. The apparatus according to claim 11 wherein the first sensor comprises a current sensor and the first characteristic comprises a current drawn by the drive motor.

14. The apparatus according to claim 11 wherein the position sensor comprises an acoustic sensor.

15. The apparatus according to claim 11 wherein the grinding wheel includes a lower surface and a grinding tooth attached to the lower surface, the grinding surface being disposed on the grinding tooth, and the reflected sensing signal being a first reflected signal, and wherein the position sensor further receives a second reflected signal reflected from the lower surface, the position sensor outputting at least one of the first reflected signal, the second reflected signal, and a tooth height signal indicating a height of the grinding tooth above the lower surface.

16. The apparatus according to claim 11, further comprising a chuck table having a securing mechanism engageable with the wafer.

17. A method of grinding a working surface, comprising:

operatively moving a grinding surface proximate the working surface;

engaging the moving grinding surface with at least a portion of the working surface;

monitoring a position of the moving grinding surface along an axis approximately normal to the working surface using a position sensor, wherein the monitoring includes transmitting a sensing signal toward the grinding surface, and receiving a reflected sensing signal from the grinding surface;

transmitting at least one of a position signal and the reflected sensing signal from the position sensor to a controller; and adjusting an operating characteristic of the moving grinding surface based on at least one of the position signal and the reflected sensing signal.

18. The method according to claim 17 wherein operatively moving a grinding surface proximate the working surface comprises rotating the grinding surface proximate the working surface.

19. The method according to claim 17 wherein adjusting an operating characteristic of the moving grinding surface based on the position signal includes adjusting a feed rate of the moving grinding surface toward the wafer.

20. The method according to claim 17 wherein operatively moving a grinding surface proximate the working surface comprises operatively moving a grinding surface having a lower surface and a grinding tooth projecting outwardly from the lower surface, the grinding surface being disposed on the grinding tooth, and wherein receiving a reflected sensing signal from the grinding surface comprises receiving a first reflected signal from the grinding surface, and wherein the monitoring further includes receiving a second reflected signal reflected from the lower surface, and wherein the transmitting comprises transmitting at least one of the position signal, the first reflected signal, the second reflected signal, and a tooth height signal indicating a height of the grinding tooth above the lower surface.

21. The method according to claim 17, further comprising monitoring a first characteristic of the moving grinding surface.

22. The method of claim 21 wherein monitoring a first characteristic of the moving grinding surface comprises monitoring a pressure of the moving grinding surface against the working surface.

23. The method of claim 21 wherein operatively moving the grinding surface proximate the working surface includes moving the grinding surface using a drive motor, and wherein monitoring a first characteristic of the moving grinding surface comprises monitoring a current drawn by the drive motor.

24. The method of claim 21 wherein adjusting an operating characteristic of the moving grinding surface includes adjusting an operating characteristic of the moving grinding surface based on at least one of the position signal and the first characteristic.

25. The method of claim 21 wherein adjusting an operating characteristic of the moving grinding surface based on the position signal includes adjusting an operating characteristic of the moving grinding surface based on both the position signal and the first characteristic.

26. A method of determining a wear condition of a grinding surface attached to a mounting surface of a grinding device, comprising:

transmitting a sensing signal onto the grinding surface and the mounting surface;

monitoring a first reflected signal from the grinding surface and a second reflected signal from the mounting surface; and determining a distance between the grinding surface and the mounting surface indicative of a wear condition of the grinding surface.

27. The method according to claim 26 wherein transmitting a sensing signal onto the grinding surface and the mounting surface comprises transmitting an acoustic signal onto the grinding surface and the mounting surface.

28. The method according to claim 26 wherein determining a distance between the grinding surface and the mounting surface includes computing a distance differential based on a time between transmitting the sensing signal and receiving the first reflected signal.

29. The method according to claim 26 wherein determining a distance between the grinding surface and the mounting surface includes computing a distance differential based on a time between receiving the first and second reflected signals.

30. The method according to claim 26 wherein transmitting a sensing signal onto the grinding surface and the mounting surface comprises transmitting an optical signal onto the grinding surface and the mounting surface.

31. The method according to claim 26 wherein the grinding device comprises a grinding wheel, the method further comprising rotating the grinding wheel.

* * * * *